US008306813B2

(12) United States Patent
Morii et al.

(10) Patent No.: US 8,306,813 B2
(45) Date of Patent: Nov. 6, 2012

(54) ENCODING DEVICE AND ENCODING METHOD

(75) Inventors: Toshiyuki Morii, Kanagawa (JP); Masahiro Oshikiri, Kanagawa (JP); Tomofumi Yamanashi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 461 days.

(21) Appl. No.: 12/528,877

(22) PCT Filed: Feb. 29, 2008

(86) PCT No.: PCT/JP2008/000400

§ 371 (c)(1),
(2), (4) Date: Aug. 27, 2009

(87) PCT Pub. No.: WO2008/108078

PCT Pub. Date: Sep. 12, 2008

(65) Prior Publication Data

US 2010/0106496 A1 Apr. 29, 2010

(30) Foreign Application Priority Data

Mar. 2, 2007 (JP) ..... 2007-053500

(51) Int. Cl.
*G10L 21/00* (2006.01)

(52) U.S. Cl. ..... 704/230; 704/200.1; 704/206; 704/207; 704/219; 704/221; 704/222; 704/223; 704/500; 704/503; 375/219; 375/223; 375/237; 375/240; 381/66; 381/124

(58) Field of Classification Search ..... 704/230, 704/200.1, 206, 207, 219, 221, 222, 223, 704/500, 503

See application file for complete search history.

(56) References Cited

U.S. PATENT DOCUMENTS

| | | | | |
|---|---|---|---|---|
| 4,868,867 | A * | 9/1989 | Davidson et al. | 704/200.1 |
| 4,908,863 | A * | 3/1990 | Taguchi et al. | 704/219 |
| 5,568,588 | A | 10/1996 | Bialik et al. | |
| 5,806,024 | A * | 9/1998 | Ozawa | 704/222 |
| 5,826,226 | A * | 10/1998 | Ozawa | 704/223 |
| 5,884,253 | A * | 3/1999 | Kleijn | 704/223 |
| 5,963,896 | A * | 10/1999 | Ozawa | 704/219 |

(Continued)

FOREIGN PATENT DOCUMENTS

EP 0 834 863 4/1998

(Continued)

OTHER PUBLICATIONS

Oshikiri et al., "A 7/10/15kHz bandwidth scalable coder using pitch filtering based spectrum coding", pp. 327-328, together with a partial English language translation; JP, Mar. 11, 2004.

(Continued)

*Primary Examiner* — Michael Colucci
(74) *Attorney, Agent, or Firm* — Greenblum & Bernstein, P.L.C.

(57) ABSTRACT

An encoding device reduces the encoding distortion as compared to the conventional technique and obtains a preferable sound quality for auditory sense. In the encoding device, a shape quantization unit quantizes the shape of an input spectrum with a small number of pulse positions and polarities. The shape quantization unit sets a pulse amplitude width to be searched later upon search of the pulse position to a value not greater than the pulse amplitude width which has been searched previously. A gain quantization unit calculates a gain of a pulse searched by the shape quantization unit for each of bands.

6 Claims, 4 Drawing Sheets

U.S. PATENT DOCUMENTS

| | | | | |
|---|---|---|---|---|
| 6,009,388 | A * | 12/1999 | Ozawa | 704/223 |
| 6,023,672 | A | 2/2000 | Ozawa | |
| 6,208,962 | B1 * | 3/2001 | Ozawa | 704/230 |
| 6,236,961 | B1 | 5/2001 | Ozawa | |
| 6,377,915 | B1 * | 4/2002 | Sasaki | 704/206 |
| 6,581,031 | B1 * | 6/2003 | Ito et al. | 704/222 |
| 6,856,955 | B1 * | 2/2005 | Ozawa | 704/221 |
| 6,973,424 | B1 * | 12/2005 | Ozawa | 704/219 |
| 6,978,235 | B1 * | 12/2005 | Ozawa | 704/219 |
| 7,693,710 | B2 * | 4/2010 | Jelinek et al. | 704/207 |
| 7,895,046 | B2 * | 2/2011 | Andersen et al. | 704/503 |
| 2009/0055169 | A1 | 2/2009 | Goto et al. | |
| 2009/0070107 | A1 | 3/2009 | Kawashima et al. | |
| 2009/0076809 | A1 | 3/2009 | Yoshida | |
| 2009/0083041 | A1 | 3/2009 | Yoshida | |
| 2009/0119111 | A1 | 5/2009 | Goto et al. | |
| 2011/0125505 | A1 * | 5/2011 | Vaillancourt et al. | 704/500 |

FOREIGN PATENT DOCUMENTS

| | | |
|---|---|---|
| EP | 0 871 158 | 10/1998 |
| JP | 6-202699 | 7/1994 |
| JP | 9-281998 | 10/1997 |
| JP | 10-69297 | 3/1998 |
| JP | 10-260698 | 9/1998 |
| JP | 10-340098 | 12/1998 |
| JP | 2004-287465 | 10/2004 |

OTHER PUBLICATIONS

Extended European Search Report, dated Jul. 1, 2011, of the corresponding European Patent Application.
English language Abstract of JP 10-340098, Dec. 22, 1998.
English language Abstract of JP 6-202699, Jul. 22, 1994.
English language Abstract of JP 2004-287465, Oct. 14, 2004.
English language Abstract of JP 10-69297, Mar. 10, 1998.
English language Abstract of JP 9-281998, Oct. 31, 1997.
English language Abstract of JP 10-260698, Sep. 29, 1998.
U.S. Appl. No. 12/529,212 to Oshikiri, filed Aug. 31, 2009.
U.S. Appl. No. 12/528,661 to Sato et al, filed Aug. 26, 2009.
U.S. Appl. No. 12/528,671 to Kawashima et al, filed Aug. 26, 2009.
U.S. Appl. No. 12/528,869 to Oshikiri et al, filed Aug. 27, 2009.
U.S. Appl. No. 12/528,659 to Oshikiri et al, filed Aug. 26, 2009.
U.S. Appl. No. 12/529,219 to Morii et al, filed Aug. 31, 2009.
U.S. Appl. No. 12/528,871 to Morii et al, filed Aug. 27, 2009.
U.S. Appl. No. 12/528,878 to Ehara, filed Aug. 27, 2009.
U.S. Appl. No. 12/528,880 to Ehara, filed Aug. 27, 2009.

* cited by examiner

ENCODING DEVICE AND ENCODING METHOD

TECHNICAL FIELD

The present invention relates to a coding apparatus and coding method for encoding speech signals and audio signals.

BACKGROUND ART

In mobile communications, it is necessary to compress and encode digital information such as speech and images for efficient use of radio channel capacity and storage media for radio waves, and many coding and decoding schemes have been developed so far.

Among these, the performance of speech coding technology has been improved significantly by the fundamental scheme of "CELP (Code Excited Linear Prediction)," which skillfully adopts vector quantization by modeling the vocal tract system of speech. Further, the performance of sound coding technology such as audio coding has been improved significantly by transform coding techniques (such as MPEG-standard ACC and MP3).

In speech signal coding based on the CELP scheme and others, a speech signal is often represented by an excitation and synthesis filter. If a vector having a similar shape to an excitation signal, which is a time domain vector sequence, can be decoded, it is possible to produce a waveform similar to input speech through a synthesis filter, and achieve good perceptual quality. This is the qualitative characteristic that has lead to the success of the algebraic codebook used in CELP.

On the other hand, a scalable codec, the standardization of which is in progress by ITU-T (International Telecommunication Union—Telecommunication Standardization Sector) and others, is designed to cover from the conventional speech band (300 Hz to 3.4 kHz) to wideband (up to 7 kHz), with its bit rate set as high as up to approximately 32 kbps. That is, a wideband codec has to even apply a certain degree of coding to audio and therefore cannot be supported by only conventional, low-bit-rate speech coding methods based on the human voice model, such as CELP. Now, ITU-T standard G.729.1, declared earlier as a recommendation, uses an audio codec coding scheme of transform coding, to encode speech of wideband and above.

Patent Document 1 discloses a scheme of encoding a frequency spectrum utilizing spectral parameters and pitch parameters, whereby an orthogonal transform and coding of a signal acquired by inverse-filtering a speech signal are performed based on spectral parameters, and furthermore discloses, as an example of coding, a coding method based on codebooks of algebraic structures.

Patent Document 1: Japanese Patent Application Laid-Open No. HEI10-260698

DISCLOSURE OF INVENTION

Problems to be Solved by the Invention

However, in a conventional scheme of encoding a frequency spectrum, limited bit information is allocated to pulse position information. On the other hand, this limited bit information is not allocated to amplitude information of the pulses, and the amplitudes of all the pulses are fixed. Consequently, coding distortion remains.

It is therefore an object of the present invention to provide a coding apparatus and coding method that can reduce average coding distortion compared to a conventional scheme and achieve good perceptual sound quality in a scheme of encoding a frequency spectrum.

Means for Solving the Problem

The coding apparatus of the present invention that models and encodes a frequency spectrum with a plurality of fixed waveforms, employs a configuration having: a shape quantizing section that searches for and encodes positions and polarities of the fixed waveforms; and a gain quantizing section that encodes gains of the fixed waveforms, and in which, upon searching for the positions of the fixed waveforms, the shape quantizing section sets an amplitude of a fixed waveform to search for later, to be equal to or lower than an amplitude of a fixed waveform searched out earlier.

The coding method of the present invention of modeling and encoding a frequency spectrum with a plurality of fixed waveforms, includes: a shape quantizing step of searching for and encoding positions and polarities of the fixed waveforms; and a gain quantizing step of encoding gains of the fixed waveforms, and in which, upon searching for the positions of the fixed waveforms, the shape quantizing step comprises setting an amplitude of a fixed waveform to search for later, to be equal to or lower than an amplitude of a fixed waveform searched out earlier.

Advantageous Effects of Invention

According to the present invention, in a scheme of encoding a frequency spectrum, by setting the amplitude of a pulse to search for later, to be equal to or lower than the amplitude of a pulse searched out earlier, it is possible to reduce average coding distortion compared to a conventional scheme and provide high quality sound quality even in a low bit rate.

BEST MODE FOR CARRYING OUT THE INVENTION

In speech signal coding based on the CELP scheme and others, a speech signal is often represented by an excitation and synthesis filter. If a vector having a similar shape to an excitation signal, which is a time domain vector sequence, can be decoded, it is possible to produce a waveform similar to input speech through a synthesis filter, and achieve good perceptual quality. This is the qualitative characteristic that has lead to the success of the algebraic codebook used in CELP.

On the other hand, in the case of frequency spectrum (vector) coding, a synthesis filter has spectral gains as its components, and therefore the distortion of the frequencies (i.e. positions) of components of large power is more significant than the distortion of these gains. That is, by searching for positions of high energy and decoding the pulses at the positions of high energy, rather than decoding a vector having a similar shape to an input spectrum, it is more likely to achieve good perceptual quality.

Therefore, frequency spectrum coding employs a model of encoding a frequency by a small number of pulses and employs a method of searching for pulses in an open loop in the frequency interval of the coding target.

The present inventors focus on the point that, since pulses are selected in order from pulses that reduce distortion, a pulse to search for later has a lower expectation value, and arrived at the present invention. That is, a feature of the present invention lies in setting the amplitude of a pulse to search for later, to be equal to or lower than the amplitude of a pulse searched out earlier.

An embodiment of the present invention will be explained below using the accompanying drawings.

Figure 1:
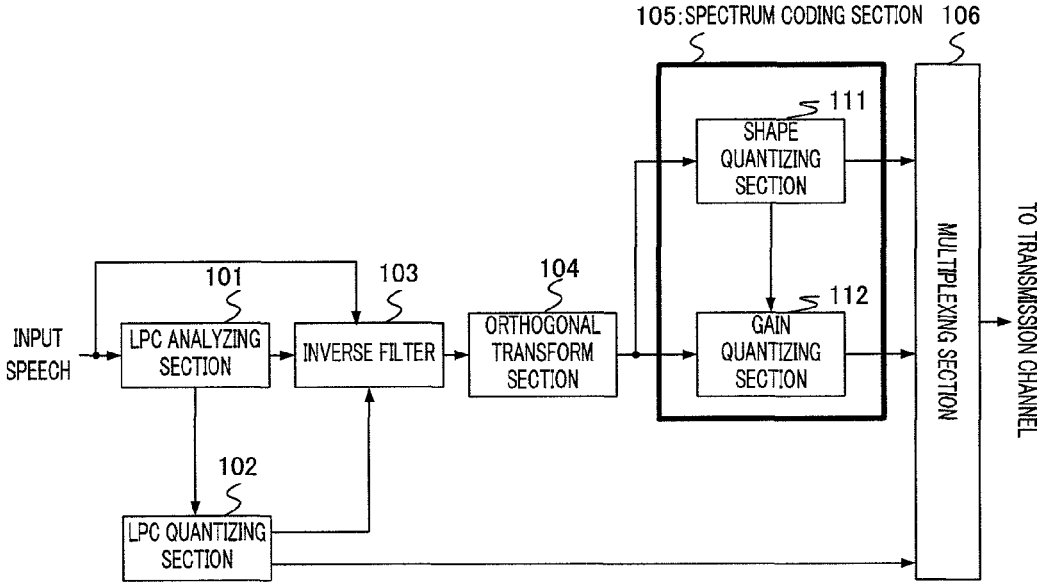
FIG. 1 is a block diagram showing the configuration of a speech coding apparatus according to an embodiment of the present invention.

FIG. 1 is a block diagram showing the configuration of the speech coding apparatus according to the present embodiment. The speech coding apparatus shown in FIG. 1 is provided with LPC analyzing section 101, LPC quantizing section 102, inverse filter 103, orthogonal transform section 104, spectrum coding section 105 and multiplexing section 106. Spectrum coding section 105 is provided with shape quantizing section 111 and gain quantizing section 112.

LPC analyzing section 101 performs a linear prediction analysis of an input speech signal and outputs a spectral envelope parameter to LPC quantizing section 102 as an analysis result. LPC quantizing section 102 performs quantization processing of the spectral envelope parameter (LPC: Linear Prediction Coefficient) outputted from LPC analyzing section 101, and outputs a code representing the quantization LPC, to multiplexing section 106. Further, LPC quantizing section 102 outputs decoded parameters acquired by decoding the code representing the quantized LPC, to inverse filter 103. Here, the parameter quantization may employ vector quantization ("VQ"), prediction quantization, multi-stage VQ, split VQ and other modes.

Inverse filter 103 inverse-filters input speech using the decoded parameters and outputs the resulting residual component to orthogonal transform section 104.

Orthogonal transform section 104 applies a match window, such as a sine window, to the residual component, performs an orthogonal transform using MDCT, and outputs a spectrum transformed into a frequency domain spectrum (hereinafter "input spectrum"), to spectrum coding section 105. Here, the orthogonal transform may employ other transforms such as the FFT, KLT and Wavelet transform, and, although their usage varies, it is possible to transform the residual component into an input spectrum using any of these.

Here, the order of processing between inverse filter 103 and orthogonal transform section 104 may be reversed. That is, by dividing input speech subjected to an orthogonal transform by the frequency spectrum of an inverse filter (i.e. subtraction in logarithmic axis), it is possible to produce the same input spectrum.

Spectrum coding section 105 divides the input spectrum by quantizing the shape and gain of the spectrum separately, and outputs the resulting quantization codes to multiplexing section 106. Shape quantizing section 111 quantizes the shape of the input spectrum using a small number of pulse positions and polarities, and gain quantizing section 112 calculates and quantizes the gains of the pulses searched out by shape quantizing section 111, on a per band basis. Shape quantizing section 111 and gain quantizing section 112 will be described later in detail.

Multiplexing section 106 receives as input a code representing the quantization LPC from LPC quantizing section 102 and a code representing the quantized input spectrum from spectrum coding section 105, multiplexes these information and outputs the result to the transmission channel as coding information.

Figure 2:
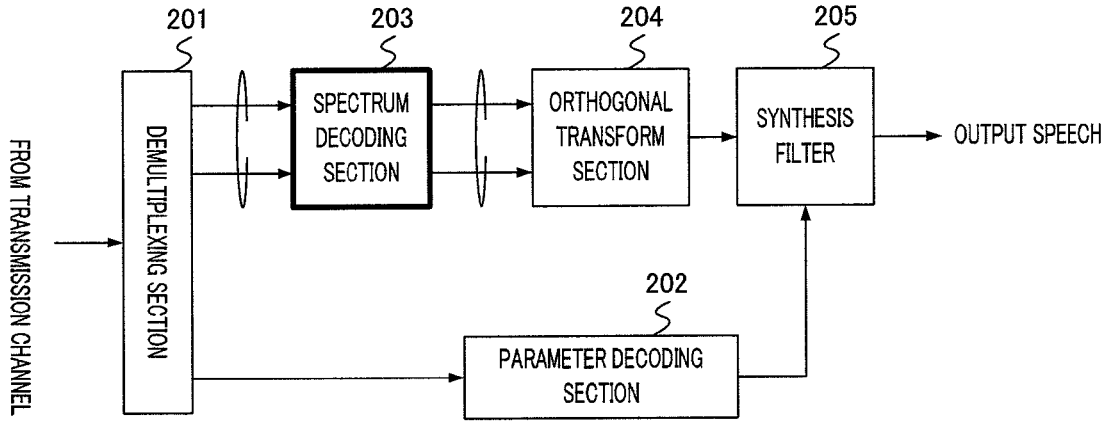
FIG. 2 is a block diagram showing the configuration of a speech decoding apparatus according to an embodiment of the present invention.

FIG. 2 is a block diagram showing the configuration of the speech decoding apparatus according to the present embodiment. The speech decoding apparatus shown in FIG. 2 is provided with demultiplexing section 201, parameter decoding section 202, spectrum decoding section 203, orthogonal transform section 204 and synthesis filter 205.

In FIG. 2, coding information is demultiplexed into individual codes in demultiplexing section 201. The code representing the quantized LPC is outputted to parameter decoding section 202, and the code of the input spectrum is outputted to spectrum decoding section 203.

Parameter decoding section 202 decodes the spectral envelope parameter and outputs the resulting decoded parameter to synthesis filter 205.

Spectrum decoding section 203 decodes the shape vector and gain by the method supporting the coding method in spectrum coding section 105 shown in FIG. 1, acquires a decoded spectrum by multiplying the decoded shape vector by the decoded gain, and outputs the decoded spectrum to orthogonal transform section 204.

Orthogonal transform section 204 performs an inverse transform of the decoded spectrum outputted from spectrum decoding section 203 compared to orthogonal transform section 104 shown in FIG. 1, and outputs the resulting, time-series decoded residual signal to synthesis filter 205.

Synthesis filter 205 produces output speech by applying synthesis filtering to the decoded residual signal outputted from orthogonal transform section 204 using the decoded parameter outputted from parameter decoding section 202.

Here, to reverse the order of processing between inverse filter 103 and orthogonal transform section 104 shown in FIG. 1, the speech decoding apparatus in FIG. 2 multiplies the decoded spectrum by a frequency spectrum of the decoded parameter (i.e. addition in the logarithmic axis) and performs an orthogonal transform of the resulting spectrum.

Next, shape quantizing section 111 and gain quantizing section 112 will be explained in detail.

Shape quantizing section 111 searches for the position and polarity (+/−) of a pulse on a one by one basis over an entirety of a predetermined search interval.

Following equation 1 provides a reference for search. Here, in equation 1, E represents the coding distortion, $s_i$ represents the input spectrum, g represents the optimal gain, δ is the delta function, p represents the pulse position, $\gamma_b$ represents the pulse amplitude, and b represents the pulse number. Shape quantizing section 111 sets the amplitude of a pulse to search for later, to be equal to or lower than the amplitude of a pulse searched out earlier.

[1]

$$E = \sum_i \left\{ s_i - \sum_b g\gamma_b \delta(i - p_b) \right\}^2 \quad \text{(Equation 1)}$$

From equation 1 above, the pulse position to minimize the cost function is the position in which the absolute value $|s_p|$ of the input spectrum in each band is maximum, and its polarity is the polarity of the value of the input spectrum value at the position of that pulse.

According to the present embodiment, the amplitude of a pulse to search for is determined in advance based on the search order of pulses. The pulse amplitude is set according to, for example, the following steps. (1) First, the amplitudes of all pulses are set to "1.0."

Further, "n" is set to "2" as an initial value. (2) By reducing the amplitude of the n-th pulse little by little and encoding/decoding learning data, the value in which the performance (such as S/N ratio and SD (Spectrum Distance)) is peak. In this case, assume that the amplitudes of the (n+1)-th or later pulses are the same as that of the n-th pulse. (3) All amplitudes with the best performance are fixed, and n=n+1 holds. (4) The processing of above (2) to (3) are repeated until n is equal to the number of pulses.

An example case will be explained where the vector length of an input spectrum is sixty four samples (six bits) and the spectrum is encoded with five pulses. In this example, six bits are required to show the pulse position (entries of positions: 16) and one bit is required to show a polarity (+/−), requiring thirty-five bits information bits in total.

Figure 3:
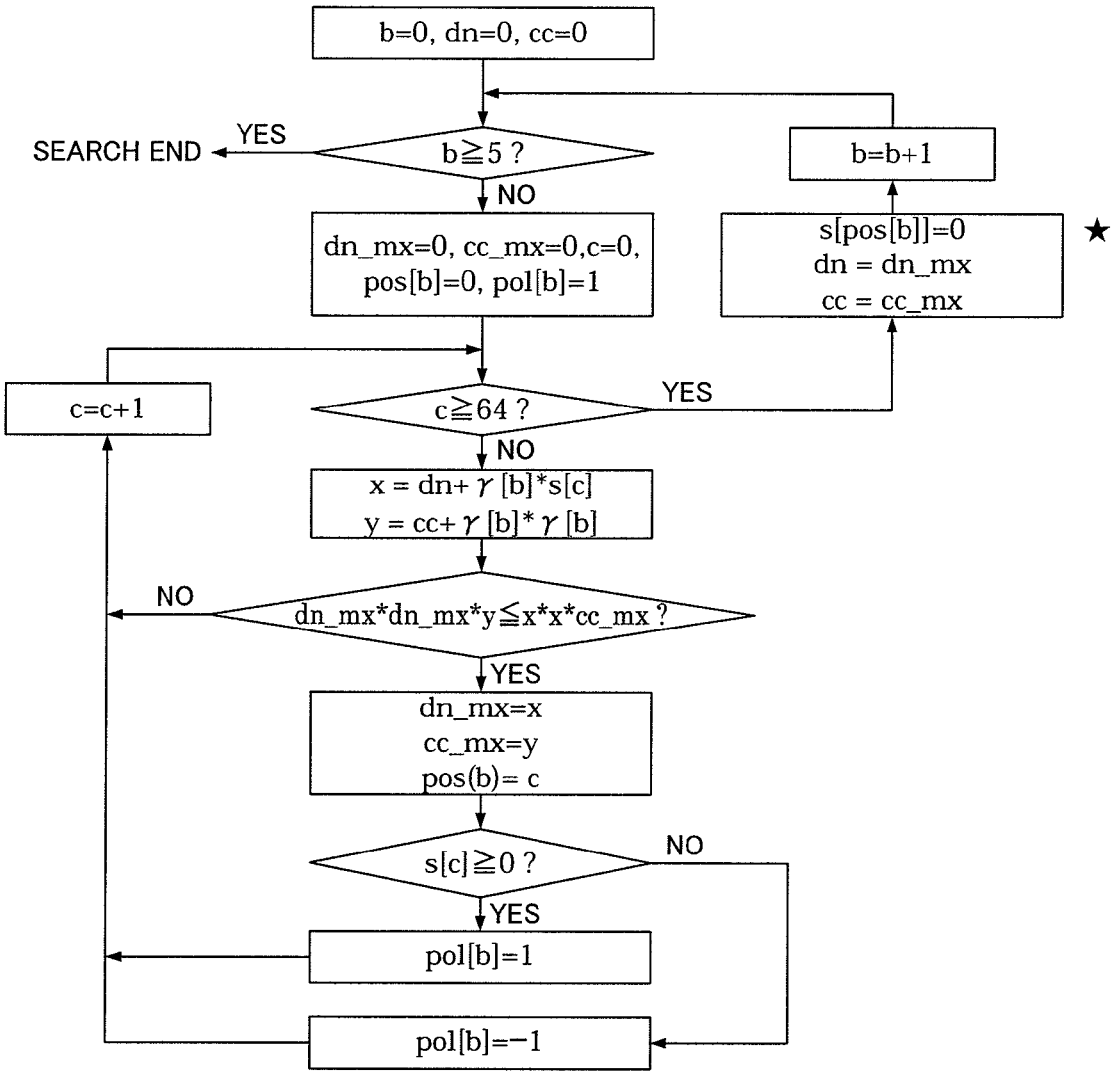
FIG. 3 is a flowchart showing the search algorithm of a shape quantizing section according to an embodiment of the present invention.

The flow of the search algorithm of shape quantizing section 111 in this example will be shown in FIG. 3. Here, the symbols used in the flowchart of FIG. 3 stand for the following contents.

c: pulse position pos[b]: search result (position)

pol[b]: search result (polarity)

s[i]: input spectrum x: numerator term y: denominator term dn_mx: maximum numerator term cc:mx maximum denominator term dn: numerator term searched out earlier cc: denominator term searched out earlier b: pulse number γ[b]: pulse amplitude FIG. 3 illustrates the algorithm of searching for the position of the highest energy and raising a pulse in the position at first, and then searching for a next pulse not to raise two pulses in the same position (see "*" mark in FIG. 3). Here, in the algorithm of FIG. 3, denominator "y" depends on only number "b," and, consequently, by calculating this value in advance, it is possible to simplify the algorithm of FIG. 3.

Figure 4:
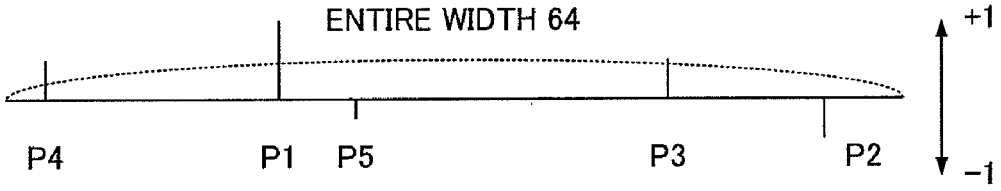
FIG. 4 is a spectrum example represented by pulses to search for by a shape quantizing section according to an embodiment of the present invention.

An example of a spectrum represented by the pulses searched out by shape quantizing section 111 will be shown in FIG. 4. Here, FIG. 4 illustrates a case where pulses P1 to P5 are searched for in order. As shown in FIG. 4, the present embodiment sets the amplitude of a pulse to search for later, to be equal to or lower than the amplitude searched out earlier. The amplitudes of pulses to search for are determined in advance based on the search order of the pulses, so that it is necessary to use information bits for representing amplitudes, and it is possible to make the overall amount of information bits the same as in the case of fixing amplitudes.

Gain quantizing section 112 analyzes the correlation between a decoded pulse sequence and an input spectrum, and calculates an ideal gain. Ideal gain "g" is calculated by following equation 2. Here, in equation 2, s(i) represents the input spectrum, and v(i) represents a vector acquired by decoding the shape.

[2]

$$g = \frac{\sum_i s(i) \times v(i)}{\sum_i v(i) \times v(i)} \quad \text{(Equation 2)}$$

Further gain quantizing section 112 calculates the idel gains and then performs coding by scalar quantization (SQ) or vector quantization. In the case of performing vector quantization, it is possible to perform efficient coding by prediction quantization, multi-stage VQ, split VQ, and so on. Here, gain can be heard perceptually based on a logarithmic scale, and, consequently, by performing SQ or VQ after performing logarithm transform of gain, it is possible to produce perceptually good synthesis sound.

Thus, according to the present embodiment, in a scheme of encoding a frequency spectrum, by setting the amplitude of a pulse to search for later, to be equal to or lower than the amplitude of a pulse searched out earlier, it is possible to reduce average coding distortion compared to a conventional scheme and achieve good sound quality even in the case of a low bit rate.

Further, by applying the present invention to a case of grouping pulse amplitudes and searching the groups in an open manner, it is possible to improve the performance. For example, when total eight pulses are grouped into five pulses and three pulses, five pulses are searched for and fixed first, and then the rest of three pulses are searched for, the amplitudes of the latter three pulses are equally reduced. It is experimentally proven that, by setting the amplitudes of five pulses searched for first to [1.0, 1.0, 1.0, 1.0, 1.0] and setting the amplitudes of three pulses searched for later to [0.8, 0.8, 0.8], it is possible to improve the performance compared to a case of setting the pulses of all pulses to "1.0."

Further, by setting the amplitudes of five pulses searched for first to "1.0," the multiplication of the amplitudes are not necessary, thereby suppressing the amount of calculations.

Further, although a case has been described above with the present embodiment where gain coding is performed after shape coding, the present invention can provide the same performance if shape coding is performed after gain coding.

Further, although an example case has been described with the above embodiment where the length of a spectrum is sixty-four and the number of pulses is five upon quantizing the shape of the spectrum, the present invention does not depend on the above numerical values and can provide the same effects with other numerical values.

Further, it may be possible to employ a method of performing gain coding on a per band basis and then normalizing the spectrum by decoded gains, and performing shape coding of the present invention. For example, if the processing of s[pos[b]]=0, dn=dn_mx and cc=cc_mx are not performed, it is possible to raise a plurality of pulses in the same position. However, if a plurality of pulses occur in the same position, their amplitudes may increase, and therefore it is necessary to check the number of pulses in each position and calculate the denominator term accurately.

Further, although coding by pulses is performed for a spectrum subjected to an orthogonal transform in the present embodiment, the present invention is not limited to this, and is also applicable to other vectors. For example, the present invention may be applied to complex number vectors in the FFT or complex DCT, and may be applied to a time domain vector sequence in the Wavelet transform or the like. Further, the present invention is also applicable to a time domain vector sequence such as excitation waveforms of CELP. As for excitation waveforms in CELP, a synthesis filter is involved, and therefore a cost function involves a matrix calculation. Here, the performance is not sufficient by a search in an open loop when a filter is involved, and therefore a close loop search needs to be performed in some degree. When there are many pulses, it is effective to use a beam search or the like to reduce the amount of calculations.

Further, according to the present invention, a waveform to search for is not limited to a pulse (impulse), and it is equally possible to search for even other fixed waveforms (such as dual pulse, triangle wave, finite wave of impulse response, filter coefficient and fixed waveforms that change the shape adaptively), and produce the same effect.

Further, although a case has been described with the preset embodiment where the present invention is applied to CELP, the present invention is not limited to this but is effective with other codecs.

Further, not only a speech signal but also an audio signal can be used as the signal according to the present invention. It is also possible to employ a configuration in which the present invention is applied to an LPC prediction residual signal instead of an input signal.

The coding apparatus and decoding apparatus according to the present invention can be mounted on a communication terminal apparatus and base station apparatus in a mobile communication system, so that it is possible to provide a communication terminal apparatus, base station apparatus and mobile communication system having the same operational effect as above.

Although a case has been described with the above embodiment as an example where the present invention is implemented with hardware, the present invention can be implemented with software. For example, by describing the algorithm according to the present invention in a programming language, storing this program in a memory and making the information processing section execute this program, it is possible to implement the same function as the coding apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2007-053500, filed on Mar. 2, 2007, including the specification, drawings and abstract, is incorporated herein by reference in its entirety.

INDUSTRIAL APPLICABILITY

The present invention is suitable to a coding apparatus that encodes speech signals and audio signals, and a decoding apparatus that decodes these encoded signals.

The invention claimed is:

1. A coding apparatus that quantizes and encodes a frequency spectrum of a transformed residual component resulting from a speech signal coding, with a shape vector which includes a plurality of pulses and a gain vector, the apparatus comprising:

a shape quantizer that performs a 1st pulse search to determine positions and signs of a plurality of 1st pulses of which amplitudes are 1.0, and after the 1st pulse search, performs a $2^{nd}$ pulse search to determine positions and signs of a plurality of 2nd pulses of which amplitudes are 0.8, and encodes positions and signs of the 1st pulses and the 2nd pulses; and a gain quantizer that encodes the gain vector based on the 1st pulses, the 2nd pulses, and the frequency spectrum.

2. The coding apparatus according to claim 1, wherein a quantity of the 1st pulses is 5, and a quantity of the 2nd pulses is less than the quantity of the 1st pulses.

3. The coding apparatus according to claim 1, wherein the shape quantizer performs the 1st pulse search and 2nd pulse search under a condition that the plurality of 1st pulses and the plurality of 2nd pulses do not occur in a same position.

4. A coding method of quantizing and encoding a frequency spectrum of a transformed residual component resulting from a speech signal coding, with a shape vector which includes a plurality of pulses and a gain vector, the method comprising:

a shape quantizing step of performing a 1st pulse search to determine positions and signs of a plurality of 1st pulses of which amplitudes are 1.0, and after the 1st pulse search, performing a 2nd pulse search to determine positions and signs of a plurality of 2nd pulses of which amplitudes are 0.8, and encoding positions and signs of the 1st pulses and the 2nd pulses; and a gain quantizing step of encoding the gain vector based on the 1st pulses, the 2nd pulses, and the frequency spectrum.

5. The coding method according to claim 4, wherein a quantity of the 1st pulses is 5, and a quantity of the 2nd pulses is less than the quantity of the 1st pulses.

6. The coding method according to claim 4, wherein, in the shape quantizing step, the 1st pulse search and 2nd pulse search are performed under a condition that the plurality of 1st pulses and the plurality of 2nd pulses do not occur in a same position.

* * * * *